US011479734B2

(12) United States Patent
Greaves et al.

(10) Patent No.: US 11,479,734 B2
(45) Date of Patent: Oct. 25, 2022

(54) SYNTHETIC LUBRICANT COMPOSITIONS HAVING IMPROVED OXIDATION STABILITY

(71) Applicant: Dow Global Technologies LLC, Midland, MI (US)

(72) Inventors: Martin R. Greaves, Horgen (CH); Evelyn A. Zaugg-Hoozemans, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 16/496,020

(22) PCT Filed: Mar. 19, 2018

(86) PCT No.: PCT/US2018/023079

§ 371 (c)(1),
(2) Date: Sep. 20, 2019

(87) PCT Pub. No.: WO2018/175285

PCT Pub. Date: Sep. 27, 2018

(65) Prior Publication Data

US 2020/0024541 A1 Jan. 23, 2020

Related U.S. Application Data

(60) Provisional application No. 62/473,582, filed on Mar. 20, 2017.

(51) Int. Cl.

| | |
|---|---|
| ***C10M 141/08*** | (2006.01) |
| ***C10M 107/34*** | (2006.01) |
| ***C10N 30/10*** | (2006.01) |
| ***C10N 40/04*** | (2006.01) |
| ***C10N 40/08*** | (2006.01) |
| ***C10N 40/25*** | (2006.01) |
| ***C10N 40/30*** | (2006.01) |

(52) U.S. Cl.

CPC ..... *C10M 141/08* (2013.01); *C10M 107/34* (2013.01); *C10M 2209/1055* (2013.01); *C10M 2215/064* (2013.01); *C10M 2219/066* (2013.01); *C10N 2030/10* (2013.01); *C10N 2040/04* (2013.01); *C10N 2040/08* (2013.01); *C10N 2040/25* (2013.01); *C10N 2040/30* (2013.01)

(58) Field of Classification Search

CPC ..... C10M 2219/068; C10M 107/34; C10M 141/06; C10M 141/08; C10M 2209/1055; C10M 2209/1075; C10M 2215/064; C10M 2219/066; C10N 2010/12; C10N 2030/10; C10N 2040/04; C10N 2040/25; C10N 2040/30; C10N 2040/08; C10N 2210/06; C10N 2230/10; C10N 2240/04; C10N 2240/08; C10N 2240/10; C10N 2240/30

See application file for complete search history.

(56) References Cited

U.S. PATENT DOCUMENTS

| | | | | |
|---|---|---|---|---|
| 4,880,551 | A | 11/1989 | Doe | |
| 5,169,564 | A | 12/1992 | Gallacher et al. | |
| 5,994,277 | A | 11/1999 | Ritchie et al. | |
| 6,806,241 | B2 | 10/2004 | Karol et al. | |
| 8,093,190 | B2 | 1/2012 | Chase et al. | |
| 2002/0144853 | A1 | 10/2002 | Martin | |
| 2007/0254821 | A1* | 11/2007 | Aguilar | C10M 141/10 508/555 |
| 2008/0312113 | A1 | 12/2008 | Beatty et al. | |
| 2014/0045736 | A1 | 2/2014 | Crawley et al. | |
| 2014/0213493 | A1 | 7/2014 | Chase et al. | |
| 2016/0068781 | A1 | 3/2016 | Yao et al. | |
| 2017/0044455 | A1* | 2/2017 | Gatto | C10M 133/44 |
| 2017/0190999 | A1 | 7/2017 | Yao et al. | |

FOREIGN PATENT DOCUMENTS

| | | | | |
|---|---|---|---|---|
| CN | 1136074 | A | 11/1996 | |
| EP | 1757673 | A1 * | 2/2007 | C10M 163/00 |
| EP | 2913384 | B1 * | 3/2017 | C10M 129/54 |
| WO | 0164820 | | 9/2001 | |
| WO | WO-0164820 | A1 * | 9/2001 | C10M 105/06 |
| WO | WO-03027215 | A2 * | 4/2003 | C10M 163/00 |
| WO | WO-2016043800 | A1 * | 3/2016 | C10M 133/10 |

OTHER PUBLICATIONS

International Preliminary Report on Patentability for related PCT Application PCT/US2018/023079, dated Oct. 3, 2019 (8 pgs).
International Search Report & Written Opinion for related PCT Application PCT/US2018/023079, dated May 25, 2018 (12 pgs).

* cited by examiner

*Primary Examiner* — Latosha Hines
(74) *Attorney, Agent, or Firm* — Brooks, Cameron & Huebsch, PLLC

(57) ABSTRACT

Embodiments of the present disclosure directed towards synthetic lubricant compositions. In various embodiments, the present disclosure provides a synthetic lubricant compositions including an aromatic amine antioxidant comprising 0.25 to 5 weight percent of a total weight of the synthetic lubricant composition, dithiocarbamate antioxidant comprising 0.25 to 5 weight percent of the total weight of the synthetic lubricant composition, and a polyalkylene glycol PAG comprising 99.25 to 85 weight percent of the total weight of the synthetic lubricant composition, where the synthetic lubricant composition has a total acidic number (TAN) increase of 2 milligrams of potassium hydroxide per gram of the synthetic lubricant composition over 27 days or greater as measured in accordance with modified ASTM D-664, and where the synthetic lubricant composition does not include any of a Group I, II, III, IV base oil.

14 Claims, No Drawings

SYNTHETIC LUBRICANT COMPOSITIONS HAVING IMPROVED OXIDATION STABILITY

This application is a National Stage Application under 35 U.S.C. § 371 of International Application Number PCT/US2018/023079, filed Mar. 19, 2018 and published as WO 2018/175285 on Sep. 27, 2018, which claims the benefit to U.S. Provisional Application 62/473,582, filed Mar. 20, 2017, the entire contents of which are incorporated herein by reference in its entirety.

FIELD OF DISCLOSURE

Embodiments of the present disclosure are directed towards synthetic lubricant compositions, more specifically, embodiments are directed towards synthetic lubricant compositions including an aromatic amine and a dithiocarbamate along with a polyalkylene glycol (PAG), the synthetic lubricant composition having an improved oxidation stability as evidenced by a total acidic number (TAN) increase of 2 milligrams of potassium hydroxide per gram of the synthetic lubricant compositions over 27 days or greater as measured in accordance with ASTM D664.

BACKGROUND

Most base oils which are used in lubricants today are derived from hydrocarbon feed stocks. Many are based on petroleum oil. In applications where higher performance is desired synthetic lubricants may be used. The dominant component of synthetic lubricants is a synthetic base oil which is manufactured via a chemical synthesis route. For example, in cold climates or in applications where the lubricant experiences very high temperatures, a synthetic lubricant may be a preferred choice. Alternatively in applications where the environmental aspects of the lubricant are important (such as biodegradability) then "Bio-lubricants" may be preferred. "Bio-lubricants" refer to lubricants derived from renewable resources such as seed oils and vegetable oils rather than from petroleum or natural gas. Bio-lubricants find particular favor in environmentally sensitive applications such as marine, forestry or agricultural lubricants due to observations that they readily biodegrade, have low toxicity and do not appear to harm aquatic organisms and surrounding vegetation. However, Bio-lubricants may have technical performance shortcomings relative to synthetic lubricants derived from petroleum or natural gas such as polyesters, polyalkylene glycols and poly(alpha-olefins), in terms of hydrolytic stability, oxidative stability and/or low temperature properties including where their pour points are often high. The above may limit their growth.

Thus, there exists a need for a synthetic lubricant composition having desired properties (e.g., oxidation stability) and/or new synthetic lubricant compositions that have even greater oxidation stability than other synthetic lubricants.

SUMMARY

The present disclosure provides a synthetic lubricant composition comprising an aromatic amine antioxidant comprising 0.25 to 5 weight percent of a total weight of the synthetic lubricant composition, dithiocarbamate antioxidant comprising 0.25 to 5 weight percent of the total weight of the synthetic lubricant composition, and a polyalkylene glycol (PAG) comprising 99.25 to 85 weight percent of the total weight of the synthetic lubricant composition, where the synthetic lubricant composition has a total acidic number (TAN) increase of 2 milligrams of potassium hydroxide (KOH) per gram of the synthetic lubricant composition over 27 days or greater as measured in accordance with ASTM D664, and where the synthetic lubricant composition does not include any of a Group I, II, III, IV base oil. That is, the synthetic lubricant compositions herein have an improved oxidation stability as evidenced by a TAN increase of 2 milligrams of KOH per gram of the synthetic lubricant compositions over 27 days or greater as compared to compositions that do not employ the dual antioxidants described herein (an aromatic amine antioxidant and a dithiocarbamate antioxidant).

In some embodiments, the present disclosure provides synthetic lubricant compositions that consist essentially of from 0.25 to 5 weight percent aromatic amine antioxidant of a total weight of the synthetic lubricant composition, from 0.25 to 5 weight percent dithiocarbamate antioxidant of the total weight of the synthetic lubricant composition, and from 99.5 to 90 weight percent PAG of the total weight of the synthetic lubricant composition, where the synthetic lubricant composition has a TAN increase of 2 milligrams of potassium hydroxide per gram of the synthetic lubricant composition over 27 days or greater as measured in accordance with modified ASTM D664.

The present disclosure provides a lubricating fluid comprising the synthetic lubricant compositions, as described herein. The lubricating fluid can be employed as hydraulic fluid, an engine fluid (i.e., engine oil), a compressor fluid, a gear oil, among possible lubricating fluid applications.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

Commercially available lubricating fluids include those based on mineral oils, polyalphaolefins (PAOs), synthetic esters, phosphate esters, vegetable oils, and polyalkylene glycols (PAGs). The different types of lubricating fluids offer varying properties such as different level of oxidation stability. Having a high oxidation stability may be desired. For example, polyalphaolefins typically have a higher oxidation stability compared to vegetable oils.

In an effort to increase oxidation stability an antioxidant may be added to a lubricant composition forming a lubricating fluid. Examples of antioxidants include phenolic antioxidants and aminic antioxidants. However, phenolic antioxidants, and/or an aminic antioxidants may not provide a desired level of oxidation stability in synthetic lubricant compositions such as those employing PAGs and/or oil soluble polyalkylene glycol (OSP).

Accordingly, the present disclosure provides a synthetic lubricant composition including an aromatic amine antioxidant and a dithiocarbamate antioxidant along with PAGs. Notably, synthetic lubricant compositions, as described herein, provide an improved oxidation stability as evidenced by a TAN increase of 2 milligrams of KOH per gram of the synthetic lubricant compositions over 27 days or greater as measured in accordance with ASTM D664 as compared to compositions that do not employ the present dual antioxidant composition (an aromatic amine antioxidant and a dithiocarbamate antioxidant). For instance, in various examples, the synthetic lubricant composition can include an aromatic amine antioxidant comprising 0.25 to 5 weight percent of a total weight of the synthetic lubricant composition, a dithiocarbamate antioxidant comprising 0.25 to 5 weight percent of the total weight of the synthetic lubricant composition, and a PAG comprising 99.25 to 85 weight percent of the total weight of the synthetic lubricant composition.

Notably in contrast to some other approaches, in various examples, the synthetic lubricant compositions do not include any of a Group I, II, III, IV base oil. Stated differently, the synthetic lubricant compositions herein do not include a Group I base oil, a Group II base oil, a Group III base oil, nor a Group IV base oil. These are classifications established by the API (American Petroleum Institute). For instance, Group III oils contain <0.03 percent sulfur and >90 percent saturates and have a viscosity index of >120. Group II oils have a viscosity index of 80 to 120 and contain <0.03 percent sulfur and >90 percent saturates. The oil can also be derived from the hydroisomerization of wax, such as slack wax or a Fischer-Tropsch synthesized wax. Such "Gas-to-Liquid" (GTL) oils are characterized as Group III base oils. Polyalphaolefins are categorized as Group IV base oil while Group V encompasses "all others".

PAG.

The PAG included in the synthetic lubricant compositions described herein is particular type of a Group V base oil. That is, in various examples, the synthetic lubricant composition can include a Group V base oil in the form of a PAG (e.g., OSP) but does not include any of a Group I, II, III, IV base oil.

PAGs suitable for use in the present disclosure are, in some non-limiting embodiments, selected from random and block copolymers derived from, for example reacting ethylene oxide (EO) and 1,2-propylene oxide (PO) with an initiator such as an alcohol or a glycol, among others. Details describing their generic synthesis can be found in Synthetics, Mineral Oils and Biobased Lubricants, Edited by L. R. Rudnick, Chapter 6, Polyalkylene glycols. Random copolymer glycols may be particularly useful herein. One or more PAGs may be used. For instance, a PAG may have an overall oxyethylene content (from EO) preferably ranging from 25 weight percent to 95 weight percent, based on the total PAG weight, the remainder being oxypropylene units (from PO). The-oxyethylene unit content more preferably ranges from 30 weight percent to 70 weight percent, and still more preferably from 40 weight percent to 60 weight percent, based on the total PAG weight, the remainder being-oxypropylene units. The PAGs may be initiated using initiators that are monols, diols, triols, tetrols, higher polyfunctional alcohols, or combinations thereof. Examples of monol initiators are methanol, ethanol, propanol, n-butanol, pentanol, hexanol, octanol, 2-ethylhexanol, decanol dodecanol and oleylalcohol. An example of a copolymer derived from ethylene oxide and propylene oxide reacted with n-butanol (a monol) is SYNALOX™ 50-30B from the Dow Chemical Company. One example of a diol initiator would be monoethylene glycol or monopropylene glycol ("MPG") and one nonlimiting example of a triol initiator is, for example, glycerol etc. In some embodiments diols may be selected.

Another type of PAG is a homopolymer in which one oxide only is reacted on to an initiator. An example is 1,2-propylene oxide reacted on to a monol initiator such as n-butanol to form a polypropylene glycol mono-butylether. An example of a homopolymer is SYNALOX™ 100-30B from the Dow Chemical Company.

A suitable PAG may be prepared by any means or method known to those skilled in the art. For example, ethene (ethylene) and propene (propylene) may be oxidized to EO and PO, respectively, using, for instance, dilute acidic potassium permanganate or osmium tetroxide. Hydrogen peroxide may alternatively be used, in a reaction transforming the alkene to the alkoxide. EO and PO may then be polymerized to form random PAG co-polymers by simultaneous addition of the oxides to an initiator such as ethylene glycol or propylene glycol and using, for example, a base catalyst, such as potassium hydroxide, to facilitate the polymerization.

In some examples, the PAG included in the synthetic lubricant composition comprises at least 40 weight percent units of the total weight of oxide derived from ethylene oxide. All individual values and subranges from at least 40 weight percent units derived from ethylene oxide are included herein and disclosed herein; for example, the amount of oxyethylene units derived from ethylene oxide can be from a lower limit of 40, 45, 50, 55 or 60 weight percent.

OSP.

In various examples, the OSP included in the synthetic lubricant composition can include a 1-dodecanol initiated random copolymer of 1,2-propylene oxide and 1,2-butylene oxide. In various examples, the OSP included in the synthetic lubricant composition comprises at least 40 weight percent units derived from 1,2-butylene oxide. All individual values and subranges from at least 40 weight percent units derived from 1,2-butylene oxide are included herein and disclosed herein; for example, the amount of units derived from 1,2-butylene oxide can be from a lower limit of 40, 45, 50, 55 or 60 weight percent.

The OSP can comprise at least 40 weight percent units of the total weight of oxide derived from 1,2-propylene oxide. All individual values and subranges from at least 40 weight percent units derived from 1,2-propylene oxide are included herein and disclosed herein; for example, the amount of units derived from 1,2-propylene oxide can be from a lower limit of 40, 45, 50, 55 or 60 weight percent.

In various examples the OSP can have an average molecular weight (i.e., weight average molecular weight) from 500 grams/(mole)mol to 2000 grams/mol. All individual values and subranges from 500 grams/mol to 1500 grams/mol are included herein and disclosed herein; for example, the average molecular weight of OSP can be from a lower limit of 500 grams/mol, 850 grams/mol or 1000 grams/mol to an upper limit of 1200 grams/mol, 1300 grams/mol, 1500 grams/mol. As used herein the average molecular weight refers to a number average molecular weight.

In various examples, the synthetic lubricant composition comprises at least 90 weight percent OSP. All individual values and subranges from 90 weight percent OSP to 99.5 weight percent OSP are included herein and disclosed herein; for example, the amount of OSP in the synthetic lubricant composition can be from a lower limit of 90, 92, 94, 95 to an upper limit of 96.00, 98.00, 98.50, 99.00, 99.25, or 99.50 weight percent OSP.

OSPs useful in embodiments of the synthetic lubricant composition are initiated by one or more initiators selected from group consisting of alcohols (i.e., monols), diols, and polyols. Alcohol (i.e., monol) initiators include methanol, ethanol, propanol, butanol, pentanol, hexanol, neopentanol, isobutanol, decanol, 2-ethylhexanol, 1-dodecanol and the like, as well as higher acyclic alcohols derived from both natural and petrochemical sources with from 11 carbon atoms to 22 carbon atoms alcohols. Exemplary diol initiators include monoethylene glycol, monopropylene glycol, butylene glycol, diethylene glycol or dipropylene glycol. Polyol initiators include neopentyl glycol, trimethylolpropane and pentaerythrithol. In some examples, the OSP is derived from copolymers of 1,2-propylene oxide and 1,2-butylene oxide or homo-polymers of 1,2 butylene oxide. Examples of suitable OSPs include those available under the tradenames UCON® and SYNALOX™ available from The Dow Chemical Company.

In some embodiments, the OSP can have a kinematic viscosity (KV) as measured according to ASTM D 445, DIN 51 550 in the range of 16 $mm^2/s$ (cSt) to 1,000 cSt at 40° C., though an OSP having a KV ranging from 20 cSt to 240 cSt at 40° C. may be selected for some applications. All individual values and subranges from 16 cSt to 1,000 cSt are included herein and disclosed herein; for example, the cSt of the OSP can be from a lower limit of 22 cSt, 44 cSt 160 cSt, 180 cSt to an upper limit of 200 cSt, 225 cSt, or 1,000 cSt.

In some embodiments, the synthetic lubricant compositions can include the aromatic amine antioxidant and the dithiocarbamate antioxidant present in a ratio from 1:5 to 5:1 weight parts of the aromatic amine antioxidant to weight parts of the dithiocarbamate antioxidant. All individual values and subranges from 1:5 to 5:1 are included herein and disclosed herein.

Antioxidants

In various examples, synthetic lubricant compositions, as described herein, can include a dual antioxidant composition including an aromatic amine antioxidant and a dithiocarbamate antioxidant.

As used herein, an aromatic amine antioxidant refers to an amine represented by formula (I):

(I)

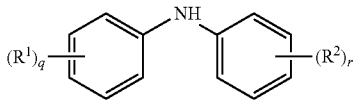

wherein R1 and R2 are independently a hydrogen or an alkyl group containing about 5 to 20 carbon atoms; or a linear or branched alkyl group containing 1 to 24 carbon atoms and q and r are each independently 0, 1, 2, or 3, provided that the sum of q and r is at least one. In some embodiments R1 and R2 are independently hydrogen or alkyl groups containing 1 to 24, 4 to 20, 5 to 16, or 6 to 12 or even 10 carbon atoms. In any of the embodiments described above, each R1 and R2 may be a linear alkyl group, a branched alkyl group, or even an alkylaryl group.

In some embodiments, the aromatic amine antioxidant can be an alkylated diphenylamine. Examples of suitable aromatic amine antioxidants include a mixed octylated and butylated diphenylamines available under the tradename VANLUBE™ 961 from R. T. Vanderbilt and mixed octylated and butylated diphenylamine available under the tradename IRGANOX™ L57 available from BASF. Alternative alkylated diphenylamines include p,p'dioctyldiphenylamine available from RT Vanderbilt as VANLUBE™ 81 and mixed nonylated diphenylamine (VANLUBE™ DND) available from RT Vanderbilt.

Dithiocarbamate Antioxidant.

The bisdithiocarbamates can be of formula II as shown below.

(II)

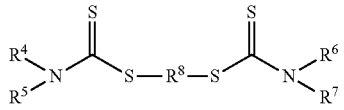

The compounds of Formula II are characterized by $R^4$, $R^5$, $R^6$ and $R^7$ which are the same or different and are hydrocarbyl groups having 1 to 13 carbon atoms. Embodiments for the present invention include bisdithiocarbamates wherein $R^4$, $R^5$, $R^6$ and $R^7$ are the same or different and are branched or straight chain alkyl groups having 1 to 8 carbon atoms. $R^8$ can be an aliphatic group such as straight and branched alkylene groups containing 1 to 8 carbons. In various embodiments, $R^8$ is methylene and structure IV can be methylenebis (dibutyldithiocarbamate), for instance, as available commercially under the tradename VANLUBE™ 996E additive from R. T. Vanderbilt Company, Inc. Dithiocarbamates which do not contain any metal ions are also known as Ashless dithiocarbamates. VANLUBE™ 996E is an ashless dithiocarbamate formed of a composition that contains a mixture of a tolytriazole derivative and methylenebis (dibutyldithiocarbamate). VANLUBE™ 996E is understood to have the following structure.

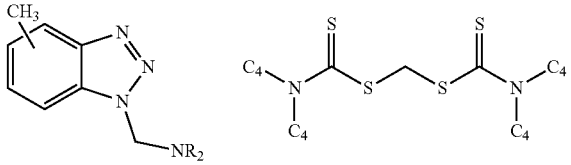

Metal Dithiocarbamates.

(IV)

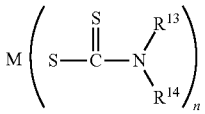

The metal dithiocarbamates of the formula IV have R13 and R14 in the formula IV represent branched and straight chain alkyl groups having 1 to 8 carbon atoms, M is a metal cation and n is an integer based upon the valency of the metal cation (e.g. n=1 for sodium (Na+); n=2 for zinc ($Zn^2$+); etc.). Embodiments for the present disclosure include metal dithiocarbamates which are antimony, zinc and molybdenum dithiocarbamates. That is, in some embodiments, the dithiocarbamate antioxidant can be derived from a Molybdenum based complex. Examples of suitable metal dithiocarbamates include those commercially available under the tradename MOLYVAN™ 807 from the R. T. Vanderbilt Company, Inc. Molyvan™ 807 is understood to have following general chemical structure:

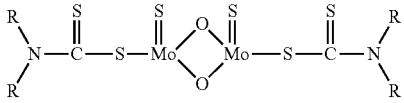

In various embodiments, the dithiocarbamate antioxidant can be a metal dithiocarbamate and/or ashless dithiocarbamate. For instance, in some embodiments, the dithiocarbamate antioxidant can be comprised of an ashless dialkyl dithiocarbamate, a metal dialkyl dithiocarbamate, or combinations thereof. In some embodiments, the dithiocarbamate antioxidant can consist essentially of the ashless dialkyl dithiocarbamate.

In some embodiments, the dual antioxidant composition of the present disclosure can be employed along with a wide variety of additional antioxidant compositions. Examples of types of additional antioxidants which can be used in combination with the PAGs include sulfur-containing compositions, phenols, oil-soluble transition metal containing compounds, phenothiazines, dithiophosphates, sulfides, sulfurized olefins, sulfurized oils including vegetable oils, sulfurized fatty acids or esters, sulfurized Diels-Alder adducts, tocopherols, phenyl-alpha-naphthylamines and/or alkylated phenyl-alpha-naphthylamines.

A combined weight of the dual antioxidant composition in the synthetic lubricant composition can be from 0.2 weight percent to 10.0 weight percent of a total weight of the synthetic lubricant composition. All individual values and subranges from 0.2 weight percent to 10.0 weight percent are included herein and disclosed herein; for example, the combined amount of the dual antioxidant composition can be from a lower limit of 0.2 weight percent, 0.5 weight percent, 0.75 weight percent to an upper limit of 1.0 weight percent, 1.25 weight percent, 1.50 weight percent, 3.0 weight percent, 5.0 weight percent, or 10.0 weight percent of a total weight of the synthetic lubricant composition.

The synthetic lubricant compositions may also include one or more conventional lubricant additives in addition to components specified above. Such additives include defoamers such as polymethylsiloxanes, demulsifiers, additional antioxidants, (for example, phenolic antioxidants such as hindered phenolic antioxidants, additional sulfurized olefins, sulfurized phenolic antioxidants, oil-soluble copper compounds, and mixtures thereof), copper corrosion inhibitors, rust inhibitors, pour point depressants, viscosity index improvers, detergents, dyes, metal deactivators, supplemental friction modifiers, diluents, combinations thereof, and the like. The conventional lubricant additives, if present, typically range from 20 parts by weight per million parts by weight ("ppmw') of synthetic lubricant composition to 2 weight percent, based upon total synthetic lubricant composition weight.

The synthetic lubricant compositions may be prepared via any method known to those skilled in the art. For example, typical blending equipment includes impeller mixers, tumble blenders, paddle and plow mixers, and single or double shaft mixers. Protocols generally prescribe charging first with a base fluid, herein a PAG having a molecular weight between 500 and 1500 g/mol, followed by components that are used in relatively small proportion, herein antioxidants, and any additional additives that have been selected, in any order.

All numerical values are "about" or "approximately" the indicated value, and take into account experimental error and variations that would be expected by a person having ordinary skill in the art. Further, various terms have been defined above. To the extent a term used in a claim is not defined above, it should be given the broadest definition persons in the pertinent art have given that term as reflected in at least one printed publication or issued patent. All patents, test procedures, and other documents cited in this application are fully incorporated by reference to the extent such disclosure is not inconsistent with this application and for all jurisdictions in which such incorporation is permitted. While the foregoing is directed to embodiments of the present invention, other and further embodiments of the invention can be devised without departing from the basic scope thereof, and the scope thereof is determined by the claims that follow.

Examples

TABLE 1

| Materials | | | |
|---|---|---|---|
| Material | Tradename | Supplier | Chemistry |
| OSP 1 | UCON ™ OSP-46 | Dow Chemical Co. | 1-Dodecanol initiated random copolymer (PO/BO, 50/50 by wt) with a typical kinematic viscosity at 40° C. of 46 $mm^2/s$ (cSt). Its average molecular weight is 1000 g/mol and viscosity index is 164. |
| OSP 2 | UCON ™ OSP-68 | Dow Chemical Co. | 1-Dodecanol initiated random copolymer (PO/BO, 50/50 by wt) with a typical kinematic viscosity at 40° C. of 68 $mm^2/s$ (cSt). Its average molecular weight is 1300 g/mol and viscosity index is 171. |
| PAG 1 | SYNALOX ™ 50-30B | Dow Chemical Co. | n-Butanol initiated random copolymer (EO/PO, 50/50 by wt) with a typical kinematic viscosity at 40° C. of 46 $mm^2/s$ (cSt). Its average molecular weight is 1000 g/mol and viscosity index is 211. |
| PAG 2 | SYNALOX ™ 100-30B | Dow Chemical Co. | Butanol initiated PO homo-polymer with a typical kinematic viscosity at 40° C. of 46 $mm^2/s$ (cSt). Its average molecular weight is 850 g/mol and viscosity index is 190. |
| Aromatic Amine 1 | Vanlube ™ 961 | RT Vanderbilt | Anti-oxidant: Octylated/butylated diphenylamine |
| Aromatic Amine 2 | Irganox ™ L57 | BASF | Anti-oxidant: Octylated/butylated diphenylamine |
| Dithiocarbamate Antioxidant 1 (Ashless) | Vanlube ™ 996E | RT Vanderbilt | Anti-oxidant: methylene bis(dibutyldithiocarbamate) and tolytriazole derivative |
| Dithiocarbamate Antioxidant 2 (Metal) | Molyvan ™ 807 | RT Vanderbilt | Molybdenum dialkyldithiocarbamate; friction reducer with anti-oxidant activity |

EXAMPLES

Sample Preparation

The synthetic lubricant compositions used in the Comparative Examples (C. Ex) and Examples (Ex.) summarized in Tables 2-4 below were made by a process identical to or similar to the following sample lubricant composition preparation process. That is, compositions which are believed to represent the invention are labelled as "Ex", whereas Comparative Examples are labelled as "C. Ex".

Preparation of Lubricant Compositions:

Ex. 1:

The synthetic lubricant composition of Example 1 was prepared by adding 99.25 weight percent of OSP 1, 0.25 weight percent of Dithiocarbamate Antioxidant 2, and 0.5 weight percent of Aromatic Amine Antioxidant 2 to a 1000 milliliter (ml) glass beaker so the total weight of the added component mixture was 500 grams (g). The component mixture was stirred under heat (30 to 50° C.) for approximately 30 minutes until it yielded a clear homogeneous synthetic lubricant composition.

Ex. 2 was prepared similar to Example 1 but instead with 98.50 weight percent of OSP 1, 1.00 weight percent of Dithiocarbamate Antioxidant 2, and 0.5 weight percent of Aromatic Amine Antioxidant 2 added to a 1000 ml glass beaker so the total weight of the added component mixture was 500 g.

C. Ex 1 was prepared similar to Example 1 but instead with 100 weight percent of OSP 1 added to a 1000 ml glass beaker so the total weight of the added component mixture was 500 g. C. Ex 2 was prepared similar to C. Ex 1 but instead with 99.75 weight percent of OSP 1 and 0.25 weight percent Dithiocarbamate Antioxidant 2 added to a 1000 ml glass beaker so the total weight of the added component mixture was 500 g. C Ex. 3 was prepared similar to the C. Ex 2 but instead with 99.00 weight percent of OSP 1 and 1.00 weight percent Dithiocarbamate Antioxidant 2 added to a 1000 ml glass beaker so the total weight of the added component mixture was 500 g. C. Ex 4 was prepared similar to Ex. 1 but instead 99.5% weight OSP1 and 0.5% by weight Aromatic amine antioxidant added to a 1000 ml glass beaker so the total weight of the added component mixture was 500 g Table 2 illustrates the performance of Ex. 1 and 2 along with C. Ex. 1-4. Testing the performance of the example and comparative examples described herein was performed using equipment in accordance with modified ASTM D-2893B (ASTM D2893-04(2009)—Standard test method for oxidation characteristics of extreme-pressure lubrication oils) and test methods in accordance with ASTM D664. That is, while ASTM D2893B measures the kinematic viscosity at 100° C. before and after 13 days of oxidation testing our modified test instead employed the total acid number (TAN) measured at certain time intervals as a synthetic lubricant composition aged. For example, 300 ml of synthetic lubricant composition was heated in a borosilicate glass tube by 121° C. dry air. That is, the TAN of the synthetic lubricant composition was measured periodically in accordance with ASTM D664 by extracting 5 mls of fluid from the glass tube each time a TAN measurement was made. The TAN was measured initially upon formation of the clear homogeneous synthetic lubricant composition and 3, 7, 13, 20, 27, 34, 41, 48, 55, 62, and 69 days thereafter. The test was concluded when the TAN increased by more than 2.0 milligram of KOH/g of synthetic lubricant composition above an initial TAN value and the elapsed time from the time of the initial TAN value was recorded in days.

TABLE 2

| Type V Base oil | Antioxidant(s) | Initial TAN Value, mg KOH/g | Time (days) to TAN increase of 2 mg KOH/g | Ex. or C. Ex |
|---|---|---|---|---|
| OSP 1 | None | 0.05 | 3 | C. Ex 1 |
| OSP 1 | Dithiocarbamate Antioxidant 2 (0.25%) | 0.12 | 3 | C. Ex 2 |

TABLE 2-continued

| Type V Base oil | Antioxidant(s) | Initial TAN Value, mg KOH/g | Time (days) to TAN increase of 2 mg KOH/g | Ex. or C. Ex |
|---|---|---|---|---|
| OSP 1 | Dithiocarbamate Antioxidant 2 (1.00%) | 0.41 | 3 | C. Ex 3 |
| OSP 1 | Aromatic Amine Antioxidant 2 (0.50%) | 0.04 | 27 | C. Ex 4 |
| OSP 1 | Dithiocarbamate Antioxidant 2 (0.25%) Aromatic Amine Antioxidant 2 (0.50%) | 0.12 | >48 | Ex. 1 |
| OSP 1 | Dithiocarbamate Antioxidant 2 (1.00%) Aromatic Amine Antioxidant 2 (0.50%) | 0.41 | 41 | Ex. 2 |

Table 3 illustrates the performance of Ex. 3, 4, 5 along with C. Ex. 5, 6. C. Ex. 5 was prepared similar to Example 1 but instead with 99.00 weight percent of OSP 2 and 1.0 weight percent of Aromatic Amine Antioxidant 1 added to a 1000 ml glass beaker so the total weight of the added component mixture was 500 g. C. Ex 6 was prepared similar to Example 1 but instead with 99.00 weight percent of OSP 2 and 1.00 weight percent of Dithiocarbamate Antioxidant 1 added to a 1000 ml glass beaker so the total weight of the added component mixture was 500 g.

Ex 3 was prepared similar to Example 1 but instead with 99.00 weight percent of OSP 2, 0.50 weight percent of Aromatic Amine 1, and 0.50 weight percent Dithiocarbamate Antioxidant 1 added to a 1000 ml glass beaker so the total weight of the added component mixture was 500 g. Ex 4 was prepared similar to Example 1 but instead with 99.00 weight percent of OSP 2, 0.75 weight percent of Aromatic Amine 1, and 0.25 weight percent Dithiocarbamate Antioxidant 1 added to a 1000 ml glass beaker so the total weight of the added component mixture was 500 g. Ex 5 was prepared similar to Example 1 but instead with 99.00 weight percent of OSP 2, 0.25 weight percent of Aromatic Amine 1, and 0.75 weight percent Dithiocarbamate Antioxidant 1 added to a 1000 ml glass beaker so the total weight of the added component mixture was 500 g.

TABLE 3

| Type V Base oil | Antioxidant(s) | Initial TAN value, mgKOH/g | Time (days) to TAN increase of 2 mgKOH/g | Ex. or C. Ex |
|---|---|---|---|---|
| OSP 2 | Aromatic Amine Antioxidant 1 (1.00%) | 0.09 | 27 | C. Ex 5 |
| OSP 2 | Dithiocarbamate Antioxidant 1 (1.00%) | 0.11 | 7 | C. Ex 6 |
| OSP 2 | Aromatic Amine Antioxidant 1 (0.50%) Dithiocarbamate Antioxidant 1 (0.50% | 0.09 | >69 | Ex. 3 |
| OSP 2 | Aromatic Amine Antioxidant 1 (0.75%) Dithiocarbamate Antioxidant 1 (0.25%) | 0.09 | 62 | Ex. 4 |
| OSP 2 | Aromatic Amine Antioxidant 1 (0.25%) | 0.11 | 55 | Ex. 5 |

TABLE 3-continued

| Type V Base oil | Antioxidant(s) | Initial TAN value, mgKOH/g | Time (days) to TAN increase of 2 mgKOH/g | Ex. or C. Ex |
|---|---|---|---|---|
| | Dithiocarbamate Antioxidant 1 (0.75%) | | | |

Table 4 illustrates the performance of Ex. 6, 7, 8 along with C. Ex. 8, 9.

C. Ex 7 was prepared similar to Example 1 but instead with 99.00 weight percent of OSP 1 and 1.00 weight percent of Aromatic Amine Antioxidant 1 added to a 1000 ml glass beaker so the total weight of the added component mixture was 500 g. C. Ex 8 was prepared similar to Example 1 but instead with 99.00 weight percent of PAG 2 and 1.00 weight percent of Aromatic Amine Antioxidant 1 added to a 1000 ml glass beaker so the total weight of the added component mixture was 500 g. C. Ex 9 was prepared similar to Example 1 but instead with 99.00 weight percent of PAG 1 and 0.50 weight percent of Aromatic Amine Antioxidant 1 added to a 1000 ml glass beaker so the total weight of the added component mixture was 500 g.

Ex. 6 was prepared similar to Example 1 but instead with 99.00 weight percent of OSP 1 and 1.00 weight percent of Aromatic Amine Antioxidant 1 added to a 1000 ml glass beaker so the total weight of the added component mixture was 500 g. Ex 7 was prepared similar to Example 1 but instead with 99.00 weight percent of PAG 2, 0.50 weight percent of Aromatic Amine 1, and 0.50 weight percent of Dithiocarbamate Antioxidant 1 added to a 1000 ml glass beaker so the total weight of the added component mixture was 500 g. Ex 8 was prepared similar to Example 1 but instead with 99.00 weight percent of PAG 1, 0.50 weight percent of Aromatic Amine 1, and 0.50 weight percent of Dithiocarbamate Antioxidant 1 added to a 1000 ml glass beaker so the total weight of the added component mixture was 500 g.

TABLE 4

| Type V Base oil | Antioxidant(s) | Initial TAN value, mgKOH/g | Time (days) to TAN increase of 2 mgKOH/g | Ex. or C. Ex |
|---|---|---|---|---|
| OSP 1 | Aromatic Amine Antioxidant 1 (1.00%) | 0.05 | 27 | C. Ex 7 |
| OSP 1 | Aromatic Amine Antioxidant 1 (0.50%) Dithiocarbamate Antioxidant 1 (0.50%) | 0.05 | 69 | Ex. 6 |
| PAG 2 | Aromatic Amine Antioxidant 1 (1.00%) | 0.04 | 20 | C. Ex 8 |
| PAG 2 | Aromatic Amine Antioxidant 1 (0.50%) Dithiocarbamate Antioxidant 1 (0.50%) | 0.04 | 69 | Ex. 7 |
| PAG 1 | Aromatic Amine Antioxidant 1 (0.50%) | 0.05 | 7 | C. Ex 9 |
| PAG 1 | Aromatic Amine Antioxidant 1 (0.50%) Dithiocarbamate Antioxidant 1 (0.50%) | 0.05 | 48 | Ex. 8 |

As shown in Tables 2-4 with regard to Working Examples 1-8, surprisingly, it has been found that an improved surprisingly longer time for the TAN of 27 days or greater is obtained when the antioxidant package includes both an aromatic amine and a dithiocarbamate as compared to the comparative examples 1-9 which do not employ both an aromatic amine and a dithiocarbamate. That is, the increased TAN of 27 days or greater is greater than the sum of the TAN times obtained from the C. Ex employing the individual antioxidants. Moreover, as is shown in examples 1 and 2 the synthetic lubricant compositions including a metal dithiocarbamate provide unexpectedly improved (long) TAN values of 41 days or greater. This is particularly surprising as metal dithiocarbamates along with other metal ion containing compounds are generally understood to catalyze the oxidation of polyether base oils such as the type V base oils employed herein.

Synthetic lubricant compositions herein can have an improved TAN of 27 days or greater, for example, a TAN from 27 days to 69 days as measured in accordance with ASTM D664. For instance, Ex. 1-8 have TAN times of greater than 48 days, 41 days, greater than 69 days, 62 days, 55 days, 69 days, 69 days, and 48 days, respectively. Synthetic lubricant compositions with such an improved TAN (e.g., greater than 27 days) can be desirable for lubricating fluid as compared to other approaches (e.g., C Ex. 1-9). For instance, in various embodiments the synthetic lubricant compositions herein can be employed included in a lubricating fluid employed as a hydraulic fluid, a gear lubricant, compressor oil and/or engine oil, among other possible lubricating fluid applications where having an improved TAN is desirable.

What is claimed:

1. A synthetic lubricant composition comprising:

a dual antioxidant package consisting of:

an alkylated diphenylamine antioxidant comprising 0.25 to 1.0 weight percent of a total weight of the synthetic lubricant composition;

a dithiocarbamate antioxidant comprising 0.25 to 0.75 weight percent of the total weight of the synthetic lubricant composition, wherein the dithiocarbamate antioxidant comprises an ashless dialkyl dithiocarbamate or a metal dialkyl dithiocarbamate, and wherein the alkylated diphenylamine antioxidant and the dithiocarbamate antioxidant are in present in a ratio from 1:5 to 5:1 weight parts of the alkylated diphenylamine antioxidant to weight parts of the dithiocarbamate antioxidant, and wherein a combined weight of the alkylated diphenylamine antioxidant and the dithiocarbamate antioxidant is from 0.50 to 1.5 weight percent of the total weight of the synthetic lubricant composition; and a polyalkylene glycol (PAG) comprising 99.25 to 85 weight percent of the total weight of the synthetic lubricant composition, wherein the synthetic lubricant composition has a total acidic number (TAN) increase of 2 milligrams of potassium hydroxide per gram of the synthetic lubricant composition over 27 days or greater as measured in accordance with ASTM D664, and wherein the synthetic lubricant composition does not include any of a Group I, II, III, IV base oil.

2. The synthetic lubricant composition of claim 1, wherein dithiocarbamate antioxidant consists essentially of an ashless dialkyl dithiocarbamate of the formula:

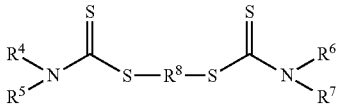

wherein $R^4$, $R^5$, $R^6$ and $R^7$ are the same or different and are branched or straight chain alkyl groups having 1 to 8 carbon atoms, and wherein $R^8$ is an aliphatic group having 1 to 8 carbons.

3. The synthetic lubricant composition of claim 2, wherein $R^4$, $R^5$, $R^6$ and $R^7$ are each a butyl group and wherein $R^8$ is a methylene group.

4. The synthetic lubricant composition of claim 1, wherein the PAG has a number average molecular weight from 800 grams/mole to 1500 grams/mole.

5. The synthetic lubricant composition of claim 1, wherein the PAG consists essentially of an oil soluble PAG (OSP) derived from copolymers of 1,2-propylene oxide and 1,2-butylene oxide or homo-polymers of 1,2 butylene oxide.

6. The synthetic lubricant composition of claim 1, wherein the synthetic lubricant composition consists essentially of:

the dual antioxidant package consisting of:

from 0.25 to 1.0 weight percent alkylated diphenylamine antioxidant of a total weight of the synthetic lubricant composition; and from 0.25 to 0.75 weight percent dithiocarbamate antioxidant of the total weight of the synthetic lubricant composition, wherein the alkylated diphenylamine antioxidant and the dithiocarbamate antioxidant are in present in a ratio from 1:5 to 5:1 weight parts of the alkylated diphenylamine antioxidant to weight parts of the dithiocarbamate antioxidant; and from 99.5 to 90 weight percent oil soluble PAG (OSP) or PAG of the total weight of the synthetic lubricant composition, wherein the synthetic lubricant composition has a TAN increase of 2 milligrams of potassium hydroxide per gram of the synthetic lubricant composition over 27 days or greater as measured in accordance with ASTM D664.

7. The synthetic lubricant composition of claim 1, wherein the composition has a TAN of from 27 days to 69 days as measured in accordance with ASTM D664.

8. A lubricating fluid comprising the synthetic lubricant composition of claim 1.

9. The synthetic lubricant composition of claim 1, wherein the dithiocarbamate antioxidant consists of a metal dithiocarbamate antioxidant.

10. The synthetic lubricant composition of claim 1, wherein the polyalkylene glycol (PAG) further comprises 99.25 to 98.50 weight percent of the total weight of the synthetic lubricant composition.

11. A dual antioxidant package consisting of:

an alkylated diphenylamine antioxidant; and a dithiocarbamate antioxidant comprising an ashless dialkyl dithiocarbamate or a metal dialkyl dithiocarbamate, and wherein the alkylated diphenylamine antioxidant and the dithiocarbamate antioxidant are in present in a ratio from 1:5 to 5:1 weight parts of the alkylated diphenylamine antioxidant to weight parts of the dithiocarbamate antioxidant.

12. The dual antioxidant package of claim 11, wherein the dithiocarbamate antioxidant is a metal dithiocarbamate antioxidant.

13. The dual antioxidant package of claim 11, wherein dithiocarbamate antioxidant is an ashless dialkyl dithiocarbamate of the formula:

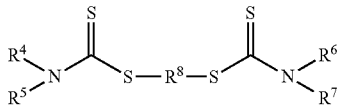

wherein $R^4$, $R^5$, $R^6$ and $R^7$ are the same or different and are branched or straight chain alkyl groups having 1 to 8 carbon atoms, and wherein $R^8$ is an aliphatic group having 1 to 8 carbons.

14. The dual antioxidant package of claim 13, wherein $R^4$, $R^5$, $R^6$ and $R^7$ are each a butyl group and wherein $R^8$ is a methylene group.

* * * * *